US006076274A

United States Patent [19]

Dreisbach

[11] Patent Number: 6,076,274

[45] Date of Patent: Jun. 20, 2000

[54] VACUUM DRYING CABINET

[76] Inventor: Bernd Dreisbach, Hüttenwiese 5, 57223 Kreuztal, Germany

[21] Appl. No.: 09/259,894

[22] Filed: Feb. 27, 1999

[30] Foreign Application Priority Data

Feb. 27, 1998 [DE] Germany ..... 198 08 408

[51] Int. Cl.[7] ..... F26B 13/30

[52] U.S. Cl. ..... 34/92; 34/211; 34/212

[58] Field of Search ..... 34/60, 61, 62, 34/65, 72, 75, 90, 92, 201, 202, 210, 211, 212; 312/31, 31.01, 31.03; 15/320, 346, 353; 118/50, 319, 320; 62/85, 475, 292

[56] References Cited

U.S. PATENT DOCUMENTS

| | | | |
|---|---|---|---|
| 3,740,860 | 6/1973 | Smith, Jr. | 34/92 X |
| 4,380,127 | 4/1983 | Roberts | 34/211 X |
| 4,597,188 | 7/1986 | Trappler | 34/92 X |
| 5,208,998 | 5/1993 | Oyler, Jr. | 34/92 X |
| 5,269,077 | 12/1993 | Bruttini | 34/92 |
| 5,398,426 | 3/1995 | Connor | 34/92 X |
| 5,911,487 | 6/1999 | Dricken | 34/92 |
| 5,937,536 | 8/1999 | Kieselbach et al. | 34/92 |
| 5,940,983 | 8/1999 | Lu | 34/212 |
| 6,003,243 | 6/1999 | Ohmi | 34/92 X |

*Primary Examiner*—Stephen Gravini
*Attorney, Agent, or Firm*—Herbert Dubno

[57] ABSTRACT

A vacuum drying cabinet has nozzles on a pipe body which can be removable from but attached to a pipe fitting mounted in the roof of the cabinet and which, when in place, can be coupled to the shaft of a motor for driving the cleaning unit and to the cleaning liquid supply. When the vacuum drying cabinet is used for vacuum drying, the cleaning unit is removed and replaced by a cap which is hermetically sealed to the pipe section.

15 Claims, 6 Drawing Sheets

16
14
50
12
17
18
5
7
6
13
22
19
27
15
21
20
1a
P
1b
5
1
2'
2''
2
3
2'''
4
2...
2
2...
2^n
11
10
9
8

VACUUM DRYING CABINET

FIELD OF THE INVENTION

My present invention relates to a vacuum drying cabinet having surfaces for receiving a product to be dried and which is provided, according to the invention, with improved cleaning.

BACKGROUND OF THE INVENTION

A vacuum drying cabinet can comprise, as has been described and illustrated in DE-OS 195 18 396, a chamber formed with surfaces, e.g. shelves, which can accommodate a product to be dried under vacuum, e.g. a pharmaceutical or a material to be converted into a pharmaceutical or a food product. The carriers or supports can be shelves which can be traversed by a heat exchange medium and thus can form heating or cooling plates, the shelves generally being located one above another and defining between them bays which open into a quiescence space or chamber. The latter can lie adjacent the door of the cabinet.

When such a vacuum drying cabinet is to be cleaned, the cleaning is generally effected manually through the open door. Food and Drug Administration (FDA) regulations or the GMP regulations (the European regulations for pharmaceutical product lines) require that the cleaning guarantee that each point in the vacuum drying cabinet be flushed with the cleaning liquid. Regulations may require a certification of the cleaning of such a cabinet to the effect that no point has been skipped by the cleaning liquid. However, in manual cleaning operations, no such assurance can be given.

There are however vacuum drying cabinets known in which cleaning devices have been integrated. For example, nozzles have been built into the individual bays or shelves or juxtaposed with them for flushing the surfaces and spaces with the cleaning liquid. Such nozzles, when they are permanently fixed in the cabinet form projections and covered edges at which contaminants can collect and which themselves cannot be cleaned as readily as can smooth surfaces. Such vacuum drying cabinets with built-in cleaning facilities have, therefore, almost as many drawbacks as systems which require manual cleaning.

OBJECTS OF THE INVENTION

It is, therefore, the principal object of the present invention to provide a vacuum drying cabinet which is free form the drawbacks described and, in particular, can ensure cleaning of the cabinet interior so as to satisfy all FDA and GMP regulations and therefore to ensure that every surface of the interior of the cabinet is properly flushed with the cleaning liquid.

It is another object of the invention to provide a vacuum drying cabinet for the purposes described which can simplify cleaning operations over manual cleaning without significantly increasing the cabinet cost.

It is also an object of the invention to provide a vacuum drying cabinet which can be automatically cleaned, i.e. cleaned without excessive manual intervention, but which will be free from projections and covered edges which might be readily contaminated and difficult to clean.

SUMMARY OF THE INVENTION

These objects and others which will become apparent hereinafter are attained, in accordance with the invention, in a vacuum drying cabinet comprising:

a housing formed with a plurality of shelves located one above another for receiving products to be dried and defining vertically separated bays, a quiescence chamber extending vertically along the bays, the bays opening toward the quiescence chamber, a floor and a roof;

a pipe fitting in the roof opening into the quiescence chamber and sealable with a removable vacuum-tight cap;

a cleaning device removable attachable to the pipe fitting in the quiescence chamber and formed with nozzles for spraying a cleaning liquid into the bays; and a supply unit affixed to the pipe fitting above the roof and having means for supplying the cleaning liquid to the cleaning device and having a shaft adapted to extend through the fitting for actuating at least one movable part of the cleaning device, the cleaning device being coupled to the means for supplying and to the shaft upon attachment of the cleaning device to the pipe fitting.

According to the invention, the roof of the cabinet is provided in the quiescence chamber with a pipe fitting which is permanently anchored in place and which is hermetically sealed to the roof. This pipe fitting can be selectively closable by a vacuum-tight cap or can accommodate a removable cleaning device which can be releasably affixed to the pipe fitting and is provided with a multiplicity of nozzles adapted to train the cleaning liquid into all corners of the cabinet and on to all surfaces thereof. The system also includes a supply unit which can be affixed to the pipe fitting and serves to supply the cleaning liquid through the pipe fitting to the cleaning unit and which has a shaft extending through the pipe fitting and adapted to be coupled to the cleaning unit for displacing same so that the streams emitted from the nozzles sweep all of the surfaces of the interior of the cabinet. The cleaning unit, when it is affixed to the pipe fitting, is likewise connected with the shaft and the supply of the cleaning liquid.

The pipe fitting thus serves to couple the supply unit and the cleaning unit together for transmission of the cleaning liquid to the cleaning unit nozzles and to couple the drive of the supply unit to the member of the cleaning unit which is actuatable by this drive. During the operation of the vacuum drying cabinet for the drying of products on the shelves, the cleaning unit and, advantageously, the supply unit, need not be mounted in place but rather the pipe fitting is hermetically sealed by the cap in a vacuum-tight manner. Only at the time of cleaning need that cap be removed and the cleaning unit mounted on the pipe fitting. At that time the supply unit, if it is not already mounted on the pipe fitting, can be fitted thereto.

I have found that a simple way of transmitting the rotary movement required for the movable part of the cleaning unit is to provide the shaft of the supply unit with a coupling to a shaft extending through the tube of the cleaning unit, the shaft of the supply unit passing coaxially through the pipe fitting. The drive shaft in the cleaning unit can, of course, also be coaxial with the nozzle assembly and with the tube. It is also possible to pass pipes through the pipe fitting or to subdivide the latter into compartments as required or to provide an inner tube which can be a coaxially received pipe fitting for the transmission of the cleaning liquid or for the transmission of movement to the latter. With a coaxial arrangement in which an inner pipe or tube is provided, the duct can be axially movable and in that case, it is possible for a reduced number of nozzle assemblies to flush a larger number of bays. An axial shifting device can be provided between the pipe fitting and the axially movable duct or tube or the axial drive can be provided externally of the pipe fitting.

The cleaning liquid can thus be introduced through a pipe fitting directly or through an axially-movable tube or duct received therein while the concentric shaft imparts rotary movement to the nozzle assemblies which can be coupled together for that purpose.

It has been found to be advantageous to provide a pipe fitting for the axially-shiftable tube at its end extending into the quiescence chamber, with a coupling element for securing the cleaning unit thereto and to provide the shaft with a coupling for transmitting the rotary movement to the shaft of the cleaning unit.

Such couplings can be plug-type or quick-connect couplings which facilitate removal of the cleaning unit and the application of the cover or cap to the tube fitting. The removability of the cleaning unit ensures that there will be no projections or covered edges contributed by the cleaning device at which contaminants can collect. Toward the bottom of the cabinet an outlet is provided which can be sealed vacuum-tight and which is opened during the cleaning operation to allow the flushing liquid and any contaminants entrained therewith to be discharged or evacuated from the cabinet. The outlet ensures that not only will the dispensed cleaning liquid be removed but any contaminants dislodged, entrained or dissolved therein, can be carried away from the cabinet with the cleaning liquid.

According to the invention, a respective nozzle assembly can be provided for each shelf or bed or the cleaning unit can have a spacing between nozzle assemblies which is a multiple of the bay spacing so that there are fewer nozzle assemblies than bays and, by the axial movement of the nozzle assemblies, the latter are aligned with one or another of the bays.

The nozzle assemblies are rotatable on their support tube via the drive previously described so that their jets completely sweep all surfaces of the bays and the shelves. The nozzles preferably are additionally rotatable about respective axes perpendicular to the axis of the support tube, i.e. horizontal axes where the support tube is vertical and a mechanism can be provided to effect such rotation during the cleaning operation.

The result is a complex spray pattern which has been found to satisfy all of other requirements of FDA and GMP regulations.

With an axial shift of the nozzle assemblies and a spacing of the nozzle assemblies which is a multiple of the bay spacing, five nozzle assemblies, for example, can be used to flush ten bays.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
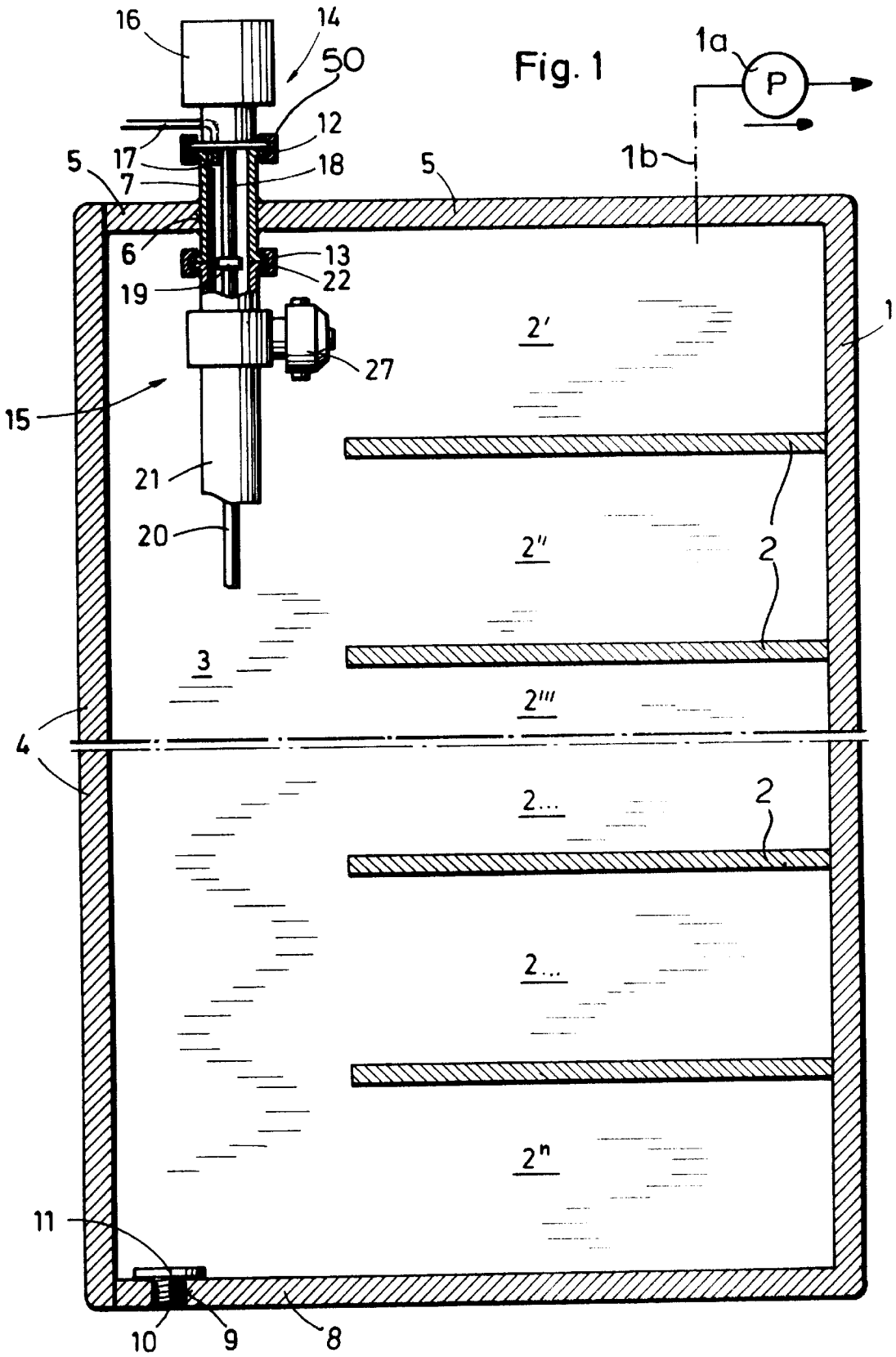
FIG. 1 is a vertical section through a vacuum drying cabinet, illustrated in highly diagrammatic form, showing the removable cleaning device in place but broken away and partly in section.

FIG. 1 shows a part of a vacuum drying cabinet which comprises a housing 1 with shelves 2 defining bays 2', 2", 2'", etc., between them, the shelves being formed as heating or cooling plates through which a heating or cooling fluid can be circulated by means not shown. The connection to a vacuum pump 1*a* is shown diagrammatically at 1*b*.

The housing 1 is provided with a quiescence or calming chamber 3 into which the bays open horizontally, and a door 4 which when opened can afford access to the bays and the shelves.

The roof 5 of the housing 1 in the region of the quiescence chamber 3 is provided with a bore 6 in which a pipe fitting 7 is welded in a vacuum-tight manner. In the bottom 8 of the cabinet 1, a further bore 9 is provided which is formed with an outlet 10 for discharging the cleaning liquid and any contaminants entrained thereby and which can be sealed in a vacuum-tight manner by a cover 11.

The pipe fitting 7 is formed on its upper and lower ends with respective flanges. To the flange 12, externally of the cabinet 1, the flange of the supply unit 14 can be affixed, e.g. via a clamp 50.

To the flange 13, a cap 51 can be secured by a clamp 53 which holds the flange 52 of the cap 51 against the flange 13 of the pipe section 7.

With removal of the cap 51, a cleaning unit 15 can be coupled to the flange via the same or a similar clamp.

The supply unit 14 comprises a drive motor 16 and a supply line 7. The drive motor 16 has a shaft 18 coaxial with the pipe section 7 and provided with a coupling 19 engageable with the drive shaft 20 for the movable parts of the cleaning device 15. The cleaning device 15 has a tubular boded 21 traversed by the drive shaft 20 and affixed to the pipe section 7 and provided with a flange 22 which can be connected to the flange 13 by a clamp similar to that shown at 53 in FIG. 2A.

Figure 2:
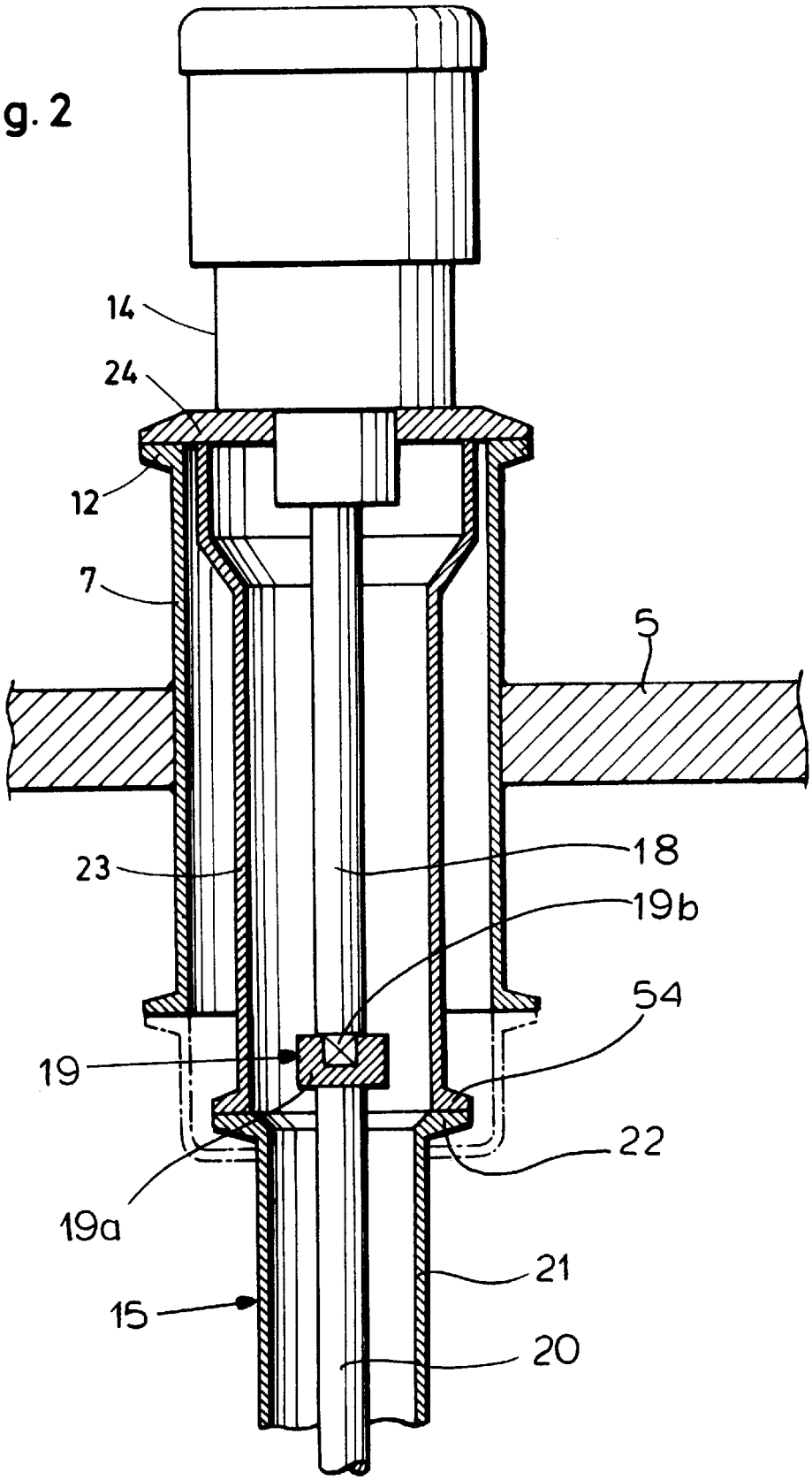
FIG. 2 is a section through the pipe fitting illustrating an embodiment in which an inner tube or duct is received in the pipe fitting and conveys the cleaning liquid to the cleaning unit.
Figure 2A:
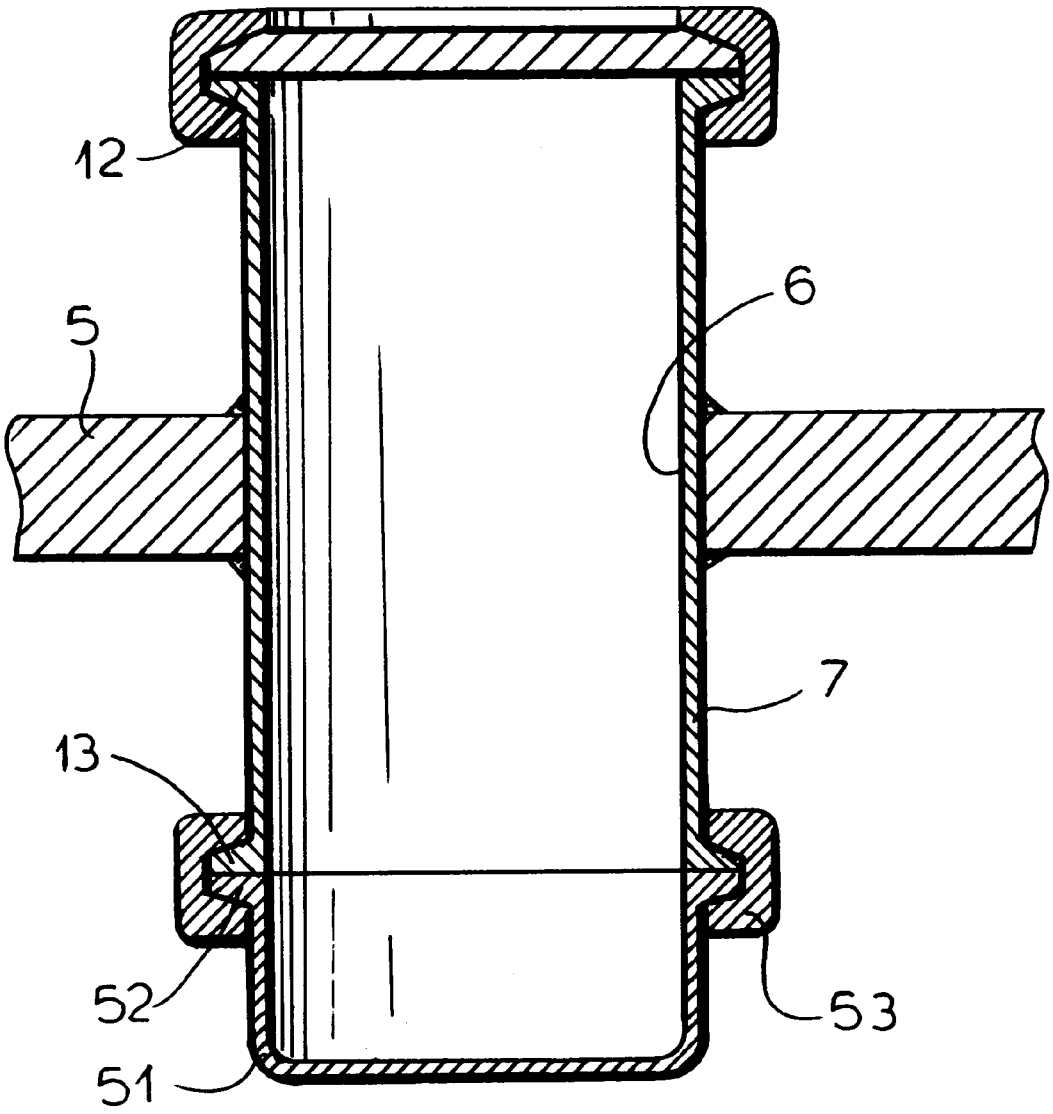
FIG. 2A is a duct of the pipe section of the cap in place.

In the embodiment of FIG. 2, a pipe section 7 receives a tube or duct 23 which is formed with a plate supported on the flange 12 and carrying the motor 16 and through which a supply line 17 delivers the cleaning liquid to the interior of the duct 23. The latter has a flange 54 which can be coupled with the flange 22 of the tubular member 21 by a clamp in the manner described. The shaft 20 has a coupling member 19*a* on the shaft 18 to form the coupling 19 alluded to earlier. The duct 23 allows a vacuum drying cabinet to be retrofitted with a supply unit 14 and a cleaning unit 15 economically.

Figure 3:
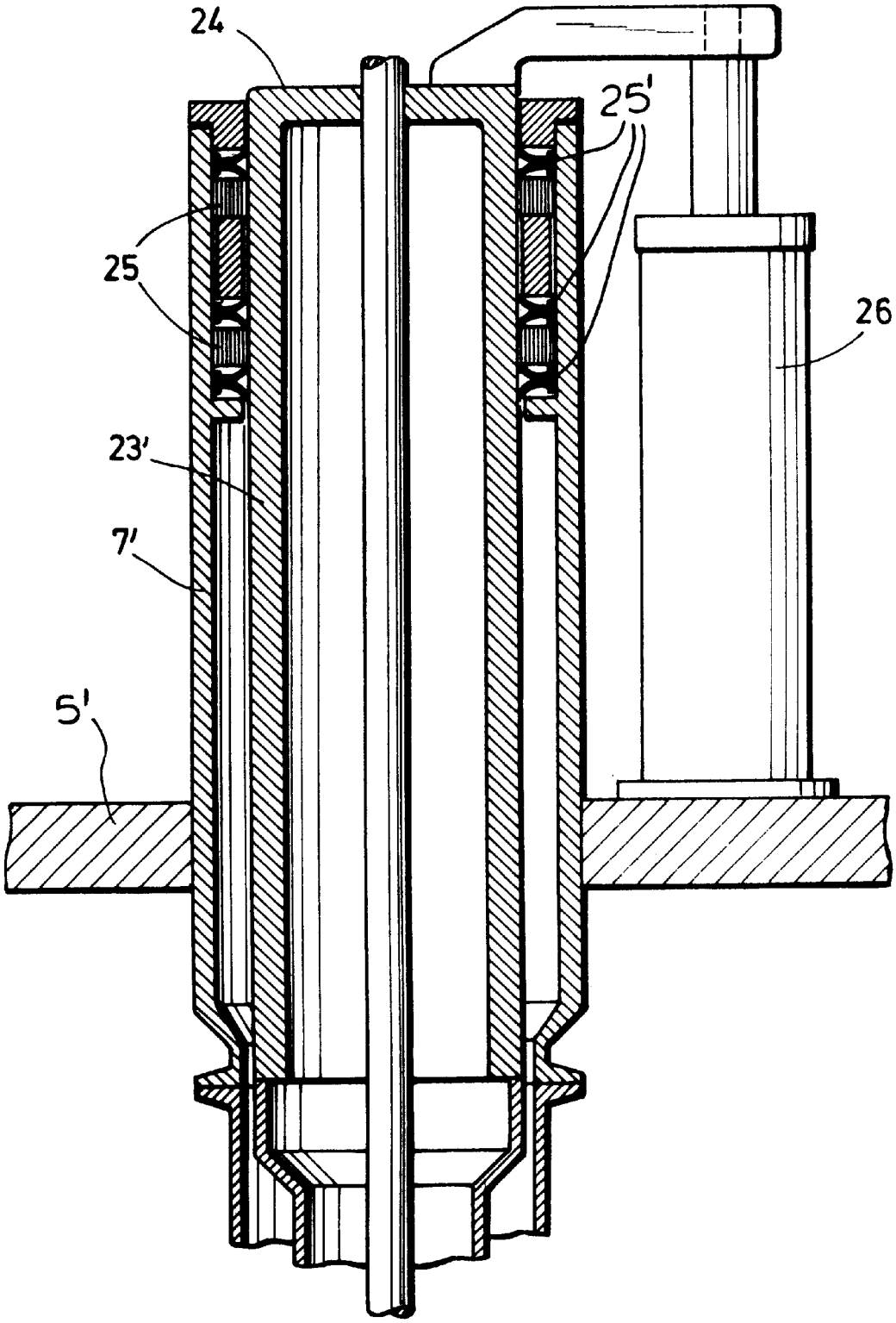
FIG. 3 is a detail of an embodiment wherein the tube section receives an axially-movable duct or tube.

FIG. 3 shows another embodiment in which an inner tube 23' is provided within a pipe section 7' mounted in the roof 5' of a vacuum drying cabinet. Here the tube 23' is axially shiftable, i.e. vertically displaceable in the pipe section 7' via axial guides which seal the tube 23' against the pipe fitting 7'. The guides 25 serve to permit axial displacement of the head 24 of tube 23' and hence the tube and the cleaning unit to align the nozzles thereof with respective bays as has been mentioned previously when there are fewer nozzle assemblies than the bays. Seals are provided at 25' along the guides 25.

At the head 24, a shifting unit 26, e.g. a hydraulic or pneumatic piston and cylinder arrangement engages the inner tube 23' to effect the axial displacement. In the case shown, the axial displacement may amount to the spacing between two bays and thus can allow half as many nozzle assemblies 27 to service the bays.

Figure 4:
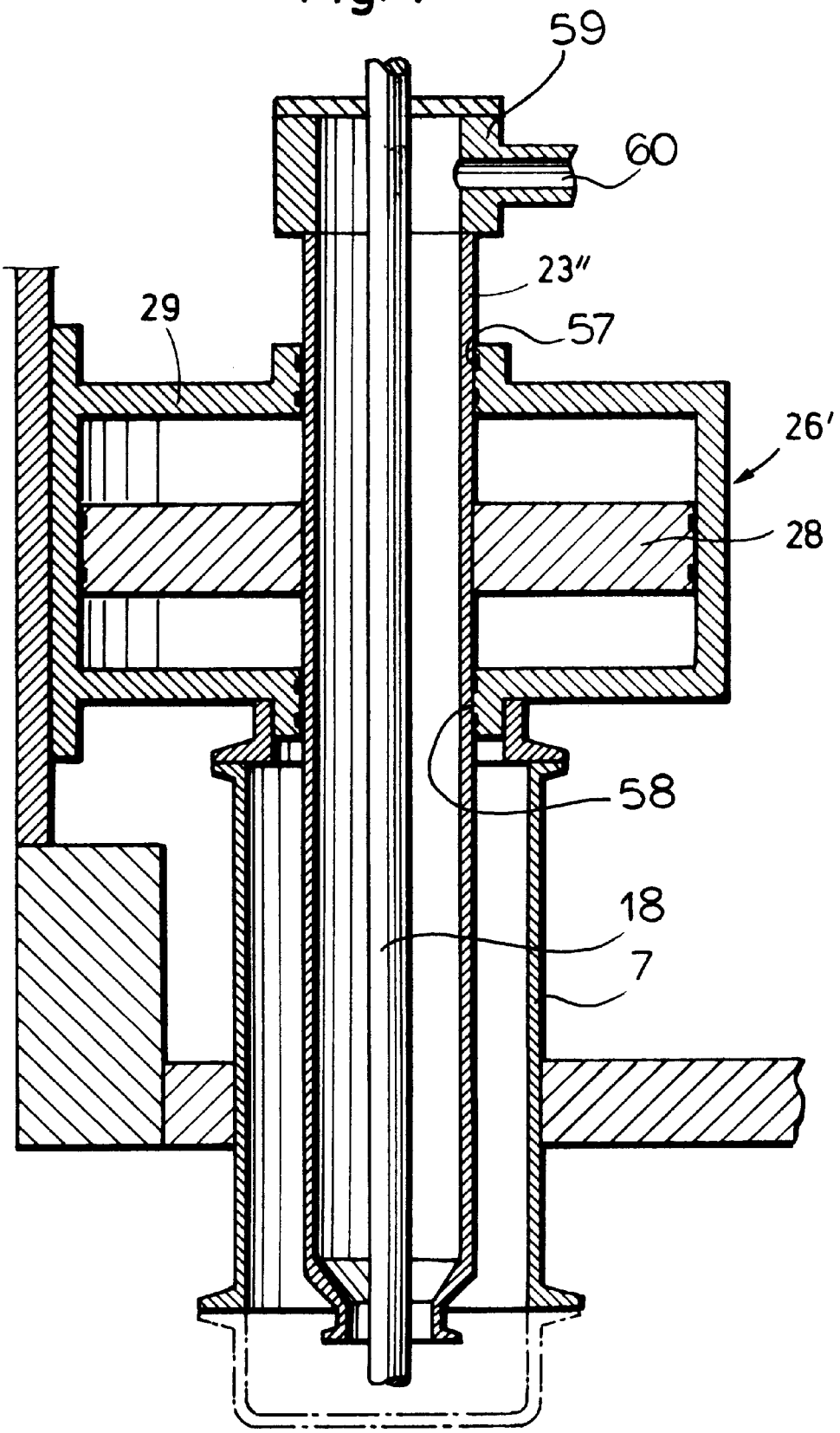
FIG. 4 is an axial cross section through a tube section showing another embodiment with axial mobility of the cleaning unit.

Another axial displacement system is shown in FIG. 4 wherein an inner duct or tube 23' is axially-shiftable in guides 57 and 58 of a cylinder 29 whose piston 28 is connected to the tube 23". The cylinder 29 and the piston 28 form the axial displacement device 26' which is equivalent to the unit 26 described in connection with FIG. 3. The cleaning fluid is supplied to the interior of the pipe 23" by a head 59 having an inlet 60. The motor 16 for the shaft 18 is mounted on the head 59. Here too the tube 23" is connected to the pipe member 21 of the cleaning unit.

Figure 5:
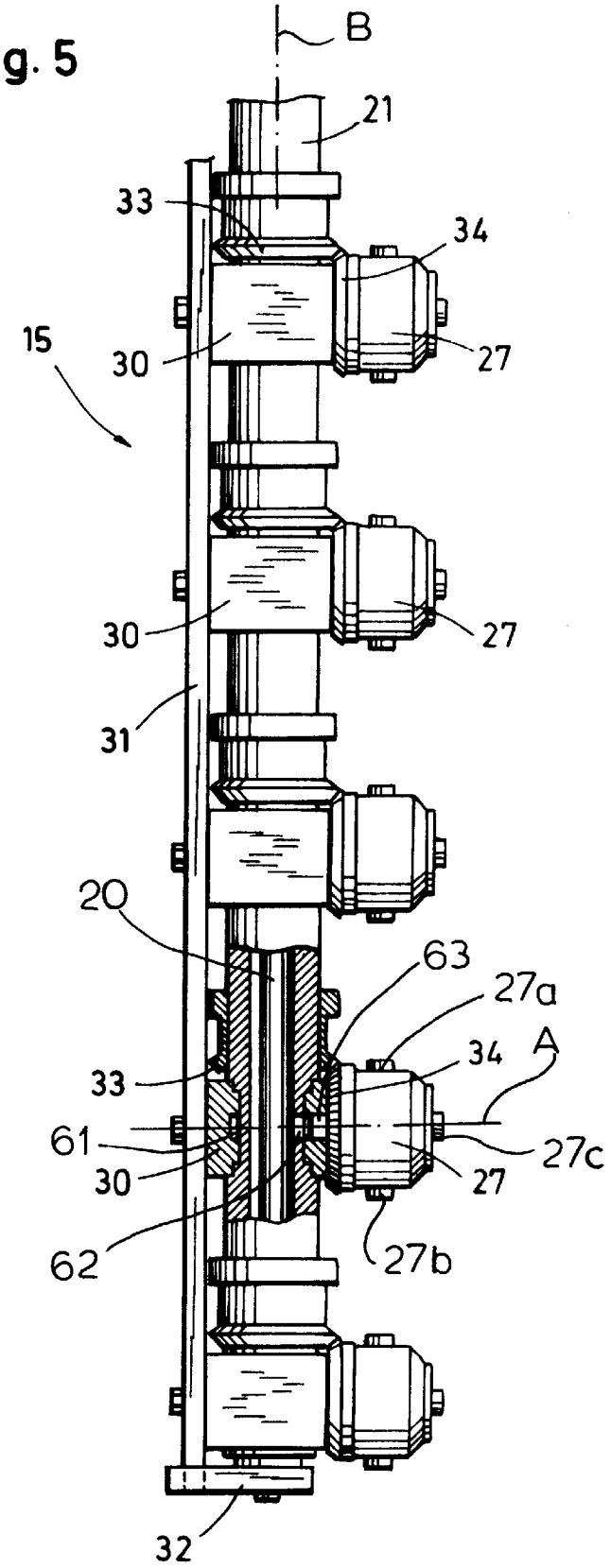
FIG. 5 is an elevational view of a part of the cleaning device, broken away over a portion of the length thereof.

As FIG. 5 shows, the cleaning unit 15 comprises a pipe body 21 previously mentioned in which a drive shaft 20 is journaled centrally, i.e. coaxial with the pipe body 21. For each nozzle assembly a respective rotatable ring 30 surrounds the pipe body 21 and carries a nozzle 27 which is rotatable about an axis A which is perpendicular to the axis B of the pipe body 21. Each nozzle 27 has orifices 27*a*, 27*b* and 27*c* arrayed around its periphery and displaced along its axis, from which the cleaning liquid is dispensed and is rotatable about the axis A. Each ring 30 has a channel 61 communicating with a radial bore 62 in the pipe body 21 and connected, in turn, with a passage 63 opening into the nozzle 27.

A bar 31 connects all of the rings 30 together and is displaced by an entrainer 32 connected to the shaft 20 so that, with rotation of the shaft, the rings 30 are rotated around the pipe body 21 and thereby swing each nozzle 27 around the pipe body as well.

Each of the rings 30 is positioned adjacent a fixed crown gear 33 and each of the nozzles 27 is formed with a bevel gear 34 meshing with the crown gear 33 so that, as the rings 30 are rotated about the vertical axis B, the nozzles 27 spin about the axes A and thus flush the entire interior of the cabinet with liquid. The nozzles 27 can be so offset angularly about the axis B that the reaction forces form the jets of liquid emerging from the nozzles are balanced and thus do not tend to urge the pipe body 21 from its vertical position.

The line 17 can be connected to pumps, tubes, tanks for the cleaning agent and the like, forming a supply source which can be mounted, if desired, upon a carriage so that this source can be connected to the different supply units 14 of a number of vacuum drying cabinets at the time each is to be cleaned.

As has been noted, when the vacuum drying cabinet is in use for vacuum drying, the cap 51 serves to seal the pipe section 7, 7' and, when cleaning is required, the cap can be removed and the cleaning unit 15 connected to the pipe section.

I claim:

1. A vacuum drying cabinet comprising:

a housing formed with a plurality of shelves located one above another for receiving products to be dried and defining vertically separated bays, a quiescence chamber extending vertically along said bays, said bays opening toward said quiescence chamber, a floor and a roof;

a pipe fitting in said roof opening into said quiescence chamber and sealable with a removable vacuum-tight cap;

a cleaning device removably attachable to said pipe fitting in said quiescence chamber and formed with nozzles for spraying a cleaning liquid into said bays; and a supply unit affixed to said pipe fitting above said roof and having means for supplying said cleaning liquid to said cleaning device and having a shaft adapted to extend through said fitting for actuating at least one movable part of said cleaning device, said cleaning device being coupled to said means for supplying and to said shaft upon attachment of said cleaning device to said pipe fitting.

2. The vacuum drying cabinet defined in claim 1 wherein said pipe fitting forms a duct for said liquid communicating with said cleaning device and said shaft extends coaxially through said duct.

3. The vacuum drying cabinet defined in claim 1 wherein a duct for said liquid extends through said pipe fitting and said shaft extends through said duct coaxially therewith.

4. The vacuum drying cabinet defined in claim 3 wherein said duct is fixed to said pipe fitting.

5. The vacuum drying cabinet defined in claim 3 wherein said duct is axially movable in said pipe fitting, said vacuum drying cabinet further comprising means between said duct and said pipe fitting for axially displacing said duct in said pipe fitting.

6. The vacuum drying cabinet defined in claim 5 wherein said duct is formed at an end extending into said quiescence chamber with means for securing said cleaning device thereto, said shaft having coupling means on an end thereof extending into the quiescent chamber for connection to a drive shaft of said cleaning device.

7. The vacuum drying cabinet defined in claim 6 wherein said cleaning device includes a vertical pipe connected to said duct and receiving said liquid therefrom, and a plurality of nozzle assemblies mounted on said vertical pipe and communicating therewith for dispensing said liquid into said bays.

8. The vacuum drying cabinet defined in claim 7 wherein said cleaning device is provided with means for connecting said drive shaft with said nozzle assemblies for rotating said nozzle assemblies on said vertical pipe.

9. The vacuum drying cabinet defined in claim 8 wherein said nozzle assemblies are formed with nozzles rotatable about axes perpendicular to said vertical pipe, said nozzles being formed with means operated by said shaft for rotating said nozzles of said assemblies about said axes.

10. The vacuum drying cabinet defined in claim 8 wherein said nozzle assemblies have a spacing which is a multiple of a spacing between said shelves and said vertical shaft is axially shiftable with said duct to position each nozzle assembly to flush a plurality of said bays.

11. The vacuum drying cabinet defined in claim 1 wherein said pipe fitting is formed at an end extending into said quiescence chamber with means for securing said cleaning device thereto, said shaft having coupling means on an end thereof extending into the quiescent chamber for connection to a drive shaft of said cleaning device.

12. The vacuum drying cabinet defined in claim 11 wherein said cleaning device includes a vertical pipe connected to said pipe fitting and receiving said liquid therefrom, and a plurality of nozzle assemblies mounted on said vertical pipe and communicating therewith for dispensing said liquid into said bays.

13. The vacuum drying cabinet defined in claim 12 wherein said cleaning device is provided with means for connecting said drive shaft with said nozzle assemblies for rotating said nozzle assemblies on said vertical pipe.

14. The vacuum drying cabinet defined in claim 13 wherein said nozzle assemblies are formed with nozzles rotatable about axes perpendicular to said vertical pipe, said nozzles being formed with means operated by said shaft for rotating said nozzles of said assemblies about said axes.

15. The vacuum drying cabinet defined in claim 13 wherein said nozzle assemblies have a spacing which is a multiple of a spacing between said shelves and said vertical shaft is axially shiftable to position each nozzle assembly to flush a plurality of said bays.

* * * * *